US005301116A

United States Patent [19]

Grünig

[11] Patent Number: 5,301,116

[45] Date of Patent: Apr. 5, 1994

[54] DEVICE FOR SETTING OF DATE STAMPS IN A POSTAGE-METER MACHINE

[75] Inventor: Rudolf Grünig, Köniz, Switzerland

[73] Assignee: Ascom Autelca AG, Bern, Switzerland

[21] Appl. No.: 953,062

[22] Filed: Sep. 29, 1992

Related U.S. Application Data

[63] Continuation of Ser. No. 591,682, Oct. 1, 1990, abandoned.

[30] Foreign Application Priority Data

Oct. 13, 1989 [CH] Switzerland ..... 03736/89

[51] Int. Cl.[5] ..... G07B 17/00

[52] U.S. Cl. ..... 364/464.02; 235/142; 235/144 PN

[58] Field of Search ..... 74/575, 577 M, 578; 235/101, 135, 142, 143, 144 PN; 364/464.02

[56] References Cited

U.S. PATENT DOCUMENTS

| | | | |
|---|---|---|---|
| 2,355,514 | 8/1944 | Deane et al. | 235/135 X |
| 2,364,345 | 10/1944 | Cooper | 101/44 |
| 2,911,279 | 11/1959 | Pollak, Jr. et al. | 101/91 X |
| 3,909,966 | 10/1975 | Satto | 235/135 X |
| 4,060,720 | 11/1977 | Check | 235/309 |
| 4,114,533 | 9/1978 | Kittredge | 101/99 |
| 4,516,014 | 5/1985 | Eckert | 235/101 |
| 4,649,489 | 3/1987 | Denzin | 364/145 X |
| 4,658,722 | 4/1987 | Muller | 101/110 |
| 4,774,881 | 10/1988 | Schubert | 101/91 |
| 4,846,715 | 7/1989 | Gasiunas et al. | 235/142 X |
| 4,852,482 | 8/1989 | Storace | 101/110 |
| 4,875,788 | 10/1989 | Gasiunas et al. | 235/142 X |

FOREIGN PATENT DOCUMENTS

| | | |
|---|---|---|
| 0105424 | 9/1988 | European Pat. Off. . |
| 74054 | 10/1892 | Fed. Rep. of Germany . |
| 1582572 | 10/1969 | France . |
| 418705 | 2/1967 | Switzerland . |
| 670524 | 6/1989 | Switzerland . |
| 1225121 | 3/1971 | United Kingdom . |
| 2130967 | 6/1984 | United Kingdom . |

OTHER PUBLICATIONS

Grüning: "Hasler Mailmaster F204 Franking Machine"; Hasler Review; vol. 11 No. 1; (no date) pp. 2–7.

*Primary Examiner*—Edward R. Cosimano
*Attorney, Agent, or Firm*—Horst M. Kasper

[57] ABSTRACT

The postage meter machine (11) comprises a stator part (12) and a print rotor (13). Two motors (41, 52), a drive (42), a motor switch (45), a battery (46), a logic unit (56), a clock module (58), and two position indicators (48, 54) are disposed in the stator part (12). A catch-stop actuator (24), a catch-stop row sequence (23) with three catch stops of different lengths as well as a date stamp (20) with four counter wheels (16–19) and a coordinated stop-catch device (26–29) are disposed in the print rotor (13). The counter wheels (16–19) are disposed coaxially next to each other and each counter wheel exhibits twelve print positions, which are rotatable stepwise by the catch-stop row sequence (23). Based on the kind of teeth and the length of the cams, either one, two or three counter wheels (16–18) are rotated simultaneously by one position. A coupler (32) connects the one motor (41) to the catch-stop actuator (24) in a certain angular setting of the print rotor (13). The logic unit (56), controls the one motor (41). Depending on the date to be set, this motor (41) runs for such a time until the catch-stop row sequence (23) has performed one, three, twelve, thirteen, sixteen, or seventeen steps.

20 Claims, 4 Drawing Sheets

| DAY | | MONTH | | YEAR |
|---|---|---|---|---|
| DECIMAL NUMERALS | SINGLE-DIGIT NUMERALS | | | |
| – | 0 | 1 | Jan. | 90 |
| 1 | 1 | 2 | Feb. | 91 |
| 2 | 2 | 3 | Mar. | 92 |
| 3 • | 3 | 4 | Apr. | 93 |
| – | 4 | 5 | May | 94 |
| 1 | 5 | 6 | June | 95 |
| 2 | 6 | 7 | July | 96 |
| 3 • | 7 | 8 | Aug. | 97 |
| – | 8 | 9 | Sept. | 98 |
| 1 | 9 | 10 | Oct. | 99 |
| 2 | – | 11 | Nov. | 00 |
| 3 • | – • | 12 | Dec. | 01 |
| 17 | 16 | 18 | | 19 |

Fig. 4

| DAY OF MONTH OR, RESPECTIVELY PRINT-POSITION COMBINATIONS OF THE COUNTER WHEELS 17 AND 16 | | | EMPTY STEPS | | | |
|---|---|---|---|---|---|---|
| -0 | 10 | 20 | | | | |
| -1 | 11 | 21 | | | | |
| -2 | 12 | 22 | | | | |
| -3 | 13 | 23 | | | | |
| -4 | 14 | 24 | | | | |
| -5 | 15 | 25 | | | | |
| -6 | 16 | 26 | | | | |
| -7 | 17 | 27 | | | | |
| -8 | 18 | 28 | | | | |
| -9 | 19 | 29 | | | | |
| -- | 1- | 2- | | | | |
| -- | 1- | 2- | | | | |
| | | 30 | | | | |
| | | 31 | | | | |
| | | 32 | IF MONTH HAS 31 DAYS | | | |
| | | 33 | | | | |
| | | 34 | | | | |
| | | 35 | | | | |
| | | 36 | | | | |
| | | 37 | | | | |
| | | 38 | | | | |
| | | 39 | | | | |
| | | 3- | | IF MONTH HAS 30 DAYS | | |
| | | 3- | | | | |
| | | -0 | | | IF FEBRUARY AND LEAP YEAR | IF FEBRUARY AND NO LEAP YEAR |

Fig.5

DEVICE FOR SETTING OF DATE STAMPS IN A POSTAGE-METER MACHINE

CROSS REFERENCE TO RELATED APPLICATIONS

This application is a continuation application of application Ser. No. 07/591,682, filed Oct. 1, 1990, now abandoned.

BACKGROUND OF THE INVENTION

1. Field of the Invention

The invention relates to a device for the setting of the date stamp of a postage-meter machine, where the postage-meter machine comprises at least a stator part and a print rotor, pivotally disposed at the stator part, as well as independent, coaxially disposed counter wheels in the print rotor, where a first counter wheel serves for setting the single-digit positions of the day of the month, a second counter wheel for the decimal positions of the day of the month, a third counter serves to set the month, and a fourth counter corresponds to the years of the date stamp.

2. Brief Description of the Background of the Invention Including Prior Art

Postage-meter machines are commercially available in diverse constructions. As a norm, these machines comprise a print rotor, which rotor includes on its cylindrical surface a postage value stamp and a date stamp. The numerals of the two stamps are adjustable.

While the value stamp in general is continuously set to new values corresponding to the amounts of postage required in each case, the setting of the date occurs only once per day. This entails that this day-setting can easily be forgotten, which would result in consequences imposed by the licensing postal authority.

The print rotor rolls during franking in each case with a full rotation over the mail pieces to be furnished with metered postage, for example, over a letter, and thereby prints successively the recited and possibly additional stamps. Such a postage-meter machine is described, for example, in Hasler Review, Vol. 11, No. 1 (Spring 1978), pp. 2–7 (R. Grünig: Hasler Mailmaster F204 Franking Machine).

A first device for the setting of a date stamp of a postage-meter machine, different from a manual setting with a stylus, is known from the Swiss Patent document CH-418,705 issued on Aug. 15, 1966. This device comprises a manually operable rotary knob which is coupled to a cam disk. If the knob is rotated, then the counter wheels of the date stamp are successively released, are switched to the next position, and are finally blocked again.

A semi-automatic setting device for the index wheels of the date stamp of a postage-meter machine is known from the European Patent application EP-105,424 published. This device exhibits adjustment tappets actuated by electromagnets. Said adjustment tappets set the index wheels step by step with gear wheels like a catch-stop drive. The adjustment tappets engage either from the outside into the print cylinder or they are actuated by gear racks supported in the axle of the print cylinder. It is true that in the latter case there is provided a compact construction, however, the equipment and financial requirements are substantial.

A further semi-automatic device for the setting of the date stamp is known from the Swiss Patent CH-670,524 issued on Jun. 15, 1989. This device uses gear racks guided within the axle of the print cylinder. The gear racks serve primarily for a setting of the counter wheels of the postage-value stamp. For this purpose, the device comprises a cam, an extension at one of the gear racks, and a spring-loaded lever. Upon coaction of these means, the index wheels of the date stamp engage with the remaining gear racks and can thus be changed via these gear racks relative to their setting.

SUMMARY OF THE INVENTION

1. Purposes of the Invention

It is an object of the invention to provide a postage-meter machine into which a completely automatic date-setting device is incorporated.

It is another object of the present invention to provide a postage-meter machine with an automatic date stamp, which will meet the severe operating conditions of a postage-meter machine and which is constructed in a correspondingly stable, strong, and sturdy manner.

These and other objects and advantages of the present invention will become evident from the description which follows.

2. Brief Description of the Invention

The present invention provides for a device for the setting of a date stamp of a postage meter machine. The device includes at least a stator part and a print rotor. The print rotor is pivotally disposed at the stator part. Counter wheels are coaxially and independently disposed in the print rotor. A first counter wheel represents single-digit positions of days of a month of the date stamp. A second counter wheel represents decimal positions of days of a month of the date stamp. A third counter wheel represents months, and a fourth counter wheel represents years of the date stamp. At least one catch-stop drive is provided and comprises an electric drive motor disposed in the stator part, a catch-stop actuator disposed in the print rotor, and a catch-stop row sequence disposed in the print rotor. The catch-stop row sequence is actuable by the catch-stop actuator and comprises at least two rigidly connected and parallel to each other disposed catch stops of differing lengths. Control means are disposed in the stator part and are coordinated to the catch-stop drive for stepwise rotating the counter wheels. The control means includes a logic unit for controlling the electric drive motor and a clock module. A coupler, coordinated to the catch-stop drive, mechanically couples the electric drive motor and the catch-stop actuator for a preset position of the print rotor. Catch-stop teeth are disposed at the counter wheels, and tooth gaps of two different depths are disposed at the counter wheels. The tooth gaps are disposed between the catch-stop teeth, and the counter wheels are individually coordinated to the catch stops. The counter wheels springingly engage the catch stops.

The catch-stop row sequence comprises three catch stops having different lengths. The longest catch stop is coordinated to the first counter wheel representing the single-digit positions of the days of the month and the first counter wheel exhibits eleven tooth gaps of a smaller depth and one tooth gap of a larger depth. The medium-length catch stop is coordinated to the second counter wheel representing the decimal positions of the days of the month and the second counter wheel exhibits nine tooth gaps of a smaller depth and three tooth gaps of a larger depth. The shortest catch stop is coordinated to the third counter wheel representing the month position and this third counter wheel does not exhibit any tooth gaps of a larger depth.

The coupler can be composed of a first half and of a second half. Said first half and said second half can be independent of each other and, upon a preset position of the print rotor, can engage into each other coaxially and with low play. The first half of the coupler can be formed by a two-sided bevelled shaft. The second half of the coupler can be formed by a slotted shaft. The two-sided bevelled shaft can be connected to the electric drive motor. The slotted shaft can be connected to the catch-stop actuator.

The catch-stop actuator can comprise a cam shaft. The catch-stop row sequence can be pivoted around a rigid axis and can be deflected by the cam shaft against the force of a spring.

Position indicators can indicate and signal the angular setting of the coupler and of the print rotor to the logic unit. The logic unit can be a microprocessor with coordinated memory storage. A control program can be stored in the memory storage.

A battery can energize the electric drive motor.

A method for operating a device according to the present invention for setting the date of the respective following day can comprise the following steps. The print rotor is initially brought into a position into which the electric drive motor and the catch-stop actuator are coupled by the coupler. The print rotor is maintained in said position. The electric drive motor is subsequently switched on in each case for such a time until, starting from the days of the month 1 through 8, 10 through 18, 20 through 28, and 30, if the month in question comprises thirty-one days, in each case one single catch-stop step is performed, until, starting from the days of the month 9, 19, and 29, in each case three catch-stop steps are performed, until, starting from the days of the month 28, 29, 30 or 31, if the month in question comprises twenty-eight, twenty-nine, thirty, or thirty-one days, in each case and coordinated seventeen, sixteen, thirteen or, respectively, twelve catch-stop steps are performed.

The setting of the date is in each case initiated at midnight with a clock module.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 4 is a tabular representation of the printed numerals of a date stamp;

FIG. 5 is a table for explaining the process of the date setting.

DESCRIPTION OF INVENTION AND PREFERRED EMBODIMENT

Figure 1:
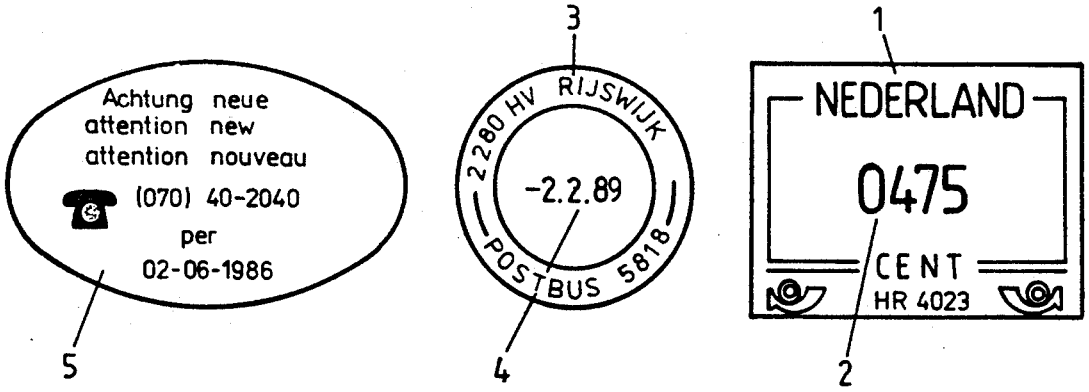
FIG. 1 is an example of a postage-meter machine print impression.

FIG. 1 illustrates an example for a stamp impression of a postage-meter machine. A four-digit amount 2 is indicated in the value stamp 1 which is, according to the example, the number 0475 having the meaning "postage value amount 4 guilders 75 cents." The round date stamp 3 is printed on the left side next to the value stamp 1. The round date stamp 3 comprises in the outer periphery an indication of the place and in the interior an indication 4 relating to the date, which is, according to the example, the date Feb. 2, 1989. Textual material and notices 5 are printed as a third item. These notices 5 are contained on an exchangeable printing block and do not have any significance relative to the postal system.

Figure 2:
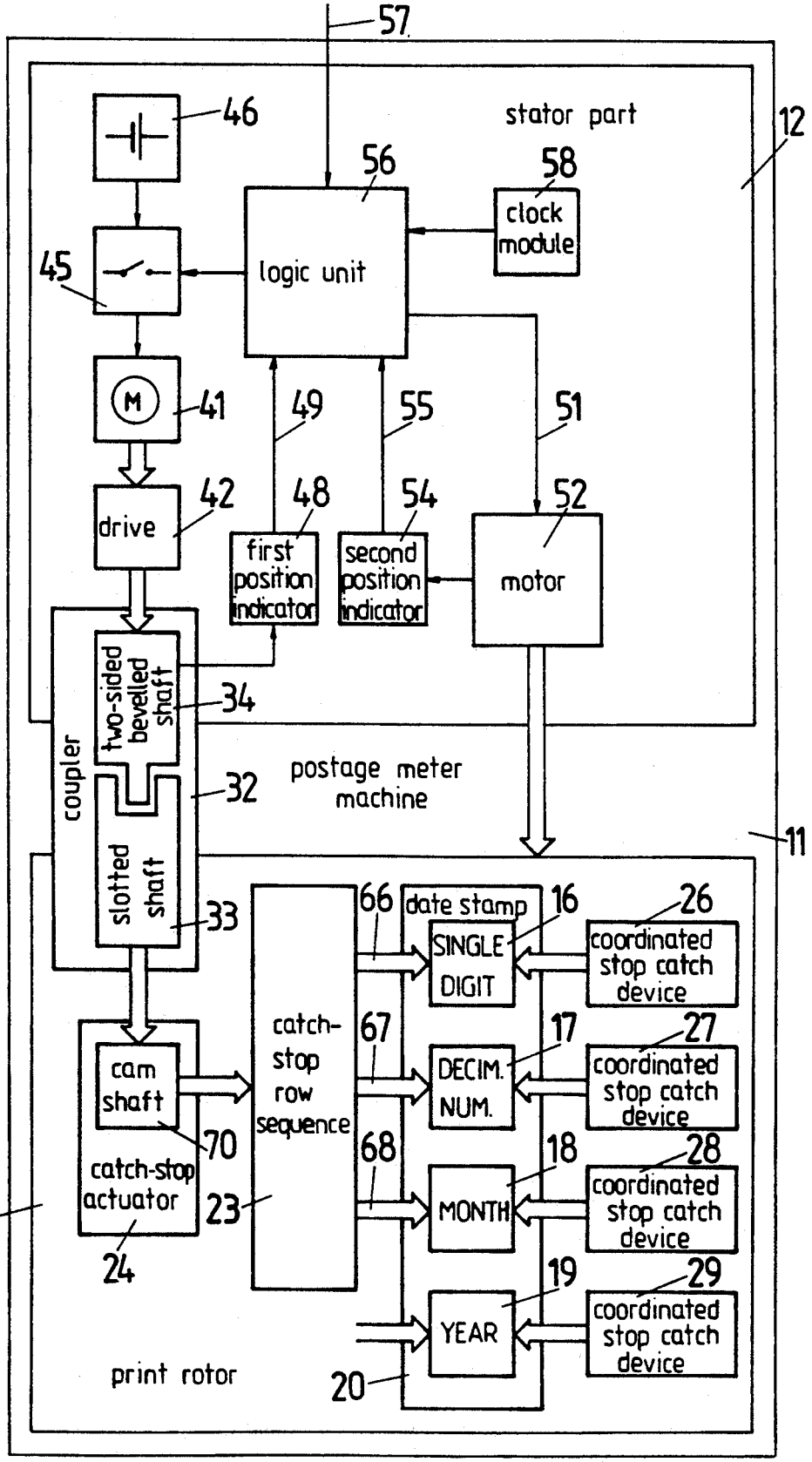
FIG. 2 is a schematic view of a block circuit diagram of a postage-meter machine.

A block circuit diagram of a postage-meter machine 11 is illustrated in FIG. 2. The thin single arrows in the illustration of FIG. 2 represent electrical connections and the thick bar arrows represent mechanical, operative connections. The postage-meter machine 11 comprises, among others, a spatially fixed stator part 12, for example called a franking work, and a rotatable print rotor 13 disposed next to the stator part 12. Four index wheels or counter wheels 16 to 19 of a date stamp 20 are coaxially disposed in the print rotor 13. Each one of the counter wheels 16 through 19 exhibits the same diameter and is associated with twelve print positions, which can be stabilized by coordinated stop-catch devices 26 through 29. The counter wheel 16 serves for printing of the single-digit numeral of the day of a month and the counter wheel 17 for the printing of the corresponding decimal numeral of a two-digit day of a month. The counter wheel 18 prints the respective month and the counter wheel 19 the corresponding year.

The print rotor 13 further comprises a catch-stop row sequence 23 with three catch stops 66 through 68, disposed in parallel and rigidly connected to each other. The catch stops 66 through 68 are engaged with the counter wheels 16 through 18 in operating contact. Furthermore, the print rotor 13 comprises a catch-stop actuator 24 as well as a slotted shaft 33 forming part of a coupler 32. The catch-stop actuator 24 comprises a cam shaft 70, which rotates together with the slotted shaft 33. The cam shaft 70 thereby moves the catch-stop row sequence 23, which can be pivoted around a rigid axle against the force of a pretensioned spring. The three catch stops 66 through 68 engage into the counter wheels 16 through 18 in a way to be described below.

The stator part 12 comprises a small drive motor 41, where a two-sided bevelled shaft 34 is following via a drive 42 as a second component of the coupler 32. A switch 45 and a battery 46 are connected in series to the drive motor 41. The franking work or stator part 12 comprises further a second, larger motor 52 with a drive for the driving of the rotor 13, a first position indicator 48 and a second position indicator 54, an electronic logic unit 56 with memory storage, and a clock module 58.

The postage-meter machine 11 operates as follows: As soon as the date stamp 20 has to be newly readjusted, the motor 52 brings the print rotor 13 into that angular position in which the two-sided bevelled shaft 34 is disposed in the slot of the slotted shaft 33. Thereby, the coupler 32 couples the drive motor 41 with the counter wheels 16 through 18. The motor 52 and the print rotor 13, following to the motor 52, are then electronically and mechanically locked in their position by the logic unit 56 via the line 51. The second position indicator 54 registers the proper angular position of the rotor 13 and delivers this value via the line 55 to the logic unit 56. This logic unit 56 now switches on the drive motor 41 via the switch 45, whereby this drive motor 41 starts and places the catch-stop actuator 24 into motion via the drive 42 and the coupler 32. The catch-stop row sequence 23 with its catch stops brings thereby in a single step one, two, or three of the counter wheels 16 through 18 in the respective next lock-engagement position. The first position indicator 48 surveys this process and sends a message via the line 49 back to the logic unit 56 if the adjustment and setting step is concluded.

The logic unit 56 receives its start order either "manually" via the input line 57, which connects a keyboard, not illustrated, of the postage-meter machine 11 with the logic unit 56. In case of the preferred automatic operation, the start order occurs, however, in each case at midnight and originates from the clock module 58. This clock module 58 is a commercial electronic component, which determines and executes the characteristics of the alternating lengths of the months of the course of the year by indicating and emitting corresponding signals.

The battery 46 is a small buffer battery which assures that the electronic device components, i.e. logic unit 56 and clock module 58, and the drive motor 41 can work also in cases where the postage-meter machine 11 is separated or switched off from the public electric power grid during the nights or on weekends. The battery thereby further allows the setting of the date independent of this public electric power grid.

Figure 3:
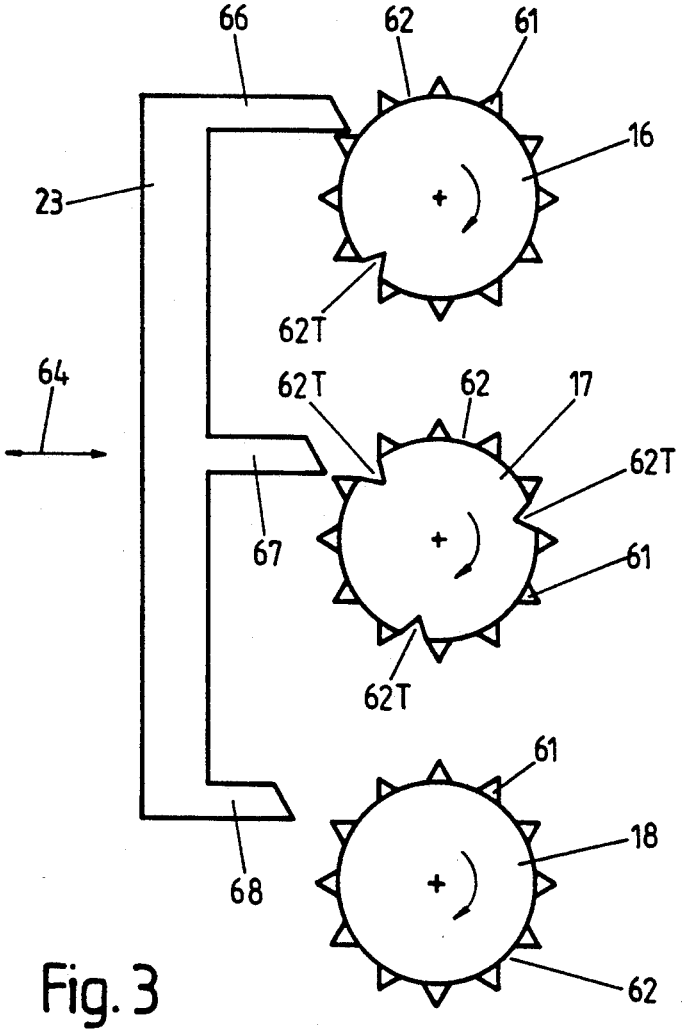
FIG. 3 is a schematic view of a catch-stop drive.

The catch-stop row sequence 23, as described, comprises three catch stops 66, 67, 68, which are rigidly connected to each other, and which are engaging the counter wheels 16, 17, 18 upon appropriate coordination. Each one of these three catch stops 66, 67, 68 has a different length. This is symbolically indicated in FIG. 3. In a practical embodiment, the counter wheels 16, 17, 18, as already mentioned, are disposed axially next to each other, and the catch stops 66, 67, 68 are of a substantially smaller size than illustrated. The catch stops 66, 67, 68 move back and forth substantially in the direction of the double arrow 64.

The counter wheels 16, 17, 18 have the same diameter and exhibit a subdivision into twelve segments, which twelve segments correspond to the recited twelve print positions. A catch-stop tooth 61 and a tooth gap 62, disposed between two catch-stop teeth 61, are coordinated to each segment. Eleven tooth gaps 62 exhibit the same depth with the counter wheel 16, whereas the twelfth tooth gap 62T is deepened relative to the other tooth gaps. Three deepened tooth gaps 62T are uniformly distributed over the wheel circumference of the counter wheel 17. The counter wheel 18 exhibits no deepened tooth gaps.

The longest catch stop 66 rests in its rest position either in a standard tooth gap 62 of the counter wheel 16, as illustrated, or is engaged in the deepened tooth gap 62T of said counter wheel 16. In the first case, i.e. when the catch stop 66 engages into a standard tooth gap 62, the remaining catch stops 67 and 68 do not reach up to touch in the tooth gaps 62 or 62T of the coordinated counter wheels 17 and 18. Therefore, in case of a back and forth motion of the catch-stop row sequence 23, only the catch stop 66 engages and rotates the counter wheel 16 into the next print position. The remaining catch stops 67 and 68 run idle and the counter wheels 17 and 18 remain in their previous position.

In the second case, the catch stop 67 is disposed in a tooth gap 62 of the counter wheel 17 and the catch stop 66 is disposed in the deepened tooth gap 62T of the counter wheel 16. Therefore, upon a back and forth motion of the catch-stop row sequence 23, the two catch stops 66 and 67 grip, engage, and rotate parallel relative to each other the coordinated counter wheels 16 or 17, respectively. If both the catch stop 66 as well as the catch stop 67 are disposed in a deepened tooth gap 62T, then also the third catch stop 68 grips, engages, and rotates the coordinated counter wheel 18 such that in this third case all counter wheels 16, 17, 18 each perform one step parallel to each other.

FIG. 4 illustrates for clarification in a tabular representation the print numerals of the counter wheels 16 through 19 and, in fact, in a way in which the date is conventionally represented in Central Europe, i.e. from the left to the right, first the day, followed by the month and the year. Thus, in the second column from the left, there are recorded the single-digit numerals of the days of a month, i.e. the numerals of the counter wheel 16. This wheel exhibits ten print positions with the numerals 0 through 9 as well as two empty positions, represented by a dash (-), i.e. a total of twelve positions. The possible decimal numbers 1 through 3 of the days of a month are shown three-fold in the far left column as well as the print position "empty." The counter wheel 17 is thus furnished also with twelve positions. The third column from the left illustrates the twelve numerals or, respectively, the twelve names of the months (counter wheel 18), and the right column illustrates the twelve years 1990 through 2001 (counter wheel 19).

Only the first of the catch stops 66, 67, 68 engages continuously into the coordinated counter wheel 16. Thus, this counter wheel 16 is advanced by one unit during each catch-stop motion. The transfer from the numeral 9 to the numeral 0 thereby requires overall three catch-stop motions, of which two serve for passage of the two recited empty positions. The deepened tooth gap 62T is illustrated by a point at the second empty position, whereby also the catch-stop 67 of the decimal counter wheel 17 becomes engaged and this decimal counter wheel 17 also performs a step. This step thus effects in each case a transfer of a decimal.

As soon as a numeral 3 of the counter wheel 17 and the second empty position of the counter wheel 16 are present simultaneously, then the third catch-stop 68 becomes engaged with the month counter wheel 18. In this case, there is performed an advancing of the month.

FIG. 5 illustrates a table of all possible days of the month or, respectively, of the print-position combinations of the counter wheels 17 and 16. In addition, empty steps are illustrated, which are to be performed by the catch-stop device in order to obtain in each case the setting of the respective next day by starting from certain days of the month. Starting from the days of the month 1 through 8, 10 through 18, 20 through 28, and 30, in case of months with thirty-one days, in each case a single catch-stop step is required in order to set the date of the respective next day. Starting from the days of the month 9, 19, and 29, there are required in each case three catch-stop steps because of the two empty positions on the counter wheel 16. Starting from the days of the month 28 in February, 29 in February in leap years, 30 with months with thirty days, and 31 with months with thirty-one days, there are in each case required in coordination seventeen, sixteen, thirteen, or, respectively, twelve catch-stop steps until in each case the date of the first day of the following month has been set.

The logic unit 56 receives daily data relating to the respective day of the month and relating to the length of the month from the clock module 58. Based on a stored program, the logic unit 56 determines with the aid of this data the respective necessary number of catch-stop motions, controls the drive motor 41, and registers the performance via the coordinated position indicator 48. Preferably, the respective date setting occurs in each case automatically at midnight.

The clock module 58 has to be set corresponding to the time of the day and to the date for initializing the device. Furthermore, the counter wheels 16, 17, 18 have to be rotated manually such that their setting corresponds to that of the clock module 58.

The counter wheel 19, for the indication of the year, can be excepted from the automatic setting based on price and cost reasons and this year indication can be set purely manually as has hitherto been done by way of a stylus. However, it is also possible without difficulty to automate also the further adjustment of the counter wheel 19 by employing a fourth catch-stop, which supplements the catch stops 66 through 68. On the other hand, the automatic further adjustment of the month could be dispensed with by eliminating the catch stop 68.

The described catch-stop arrangement is simple in its mechanical construction and requires no transfer wheels and transfer cams between the counter wheels 16 through 18. Furthermore, a change-over from the Central European date format to another format, in particular to the Anglo-Saxon date format, can easily be performed by way of a simple resetting of the catch stops 66 through 68 and of the counter wheels 16 through 18.

The catch-stop actuator 24 can for example be formed as a rotatable cam disk, which moves the pivotable catch-stop row sequence 23 back and forth around a rigid axis. The catch-stop row sequence 23 is spring-loaded such that the catch stops 66 through 68 as described are disposed in the tooth gaps 62, 62T of the counter wheels 16 through 18.

The coupler 32 is composed of two independent halves, as described above, and is preferably made of a slotted shaft 33 and a two-sided bevelled shaft 34. These two halves engage coaxially and with a small amount of play. As soon as the print rotor 13 rotates, the two shafts, of course, have to be directed tangentially to the rotor 13 with the slot or, respectively, with the bevel. This can be controlled by the first position sensor and indicator 48. The coupler 32, however, can also be of different construction, for example, a magnet coupling.

The first position indicator 48 is furnished preferably as a spring-loaded, single-side supported lever, which is deflected by a cam disk and which thereby engages into a light barrier. The cam of the cam disk is thereby formed such that for each rotation of the two-sided bevelled shaft 34, there occurs in each case precisely one single back and forth motion of the lever.

The drive motor 41 can be formed as desired, and it is preferred to employ a collectorless DC motor of low power and low voltage.

The second motor 52 is a substantially larger motor which is preferably operated directly by the public AC grid, i.e. with a voltage of 110 or 220 volts.

The second position indicator 54 comprises preferably a permanent magnet. This permanent magnet is attached at the axle of the rotor 13 and operates and actuates a spatially fixedly installed magnetic sensor (Hall effect).

The blocking of the print rotor 13 during the setting of the counter wheels 16 through 18 can be performed in various different ways. Preferably, the general rest position of the rotor 13 is used as the position where the two halves of the coupler 32 are engaging each other.

The logic unit 56 is preferably formed by employing a commercially available microprocessor with a corresponding semiconductor memory, which comprises a control program. In this case, the processor can, in addition to the above-described date setting function, of course also accept further control and surveillance task of the postage-meter machine 11.

The device for the setting of the date stamp combines a simple, sturdy and thus low-interference mechanics with a relatively expensive electronic control. Since such electronic controls are at any rate already present in the case of modern postage-meter machines, there is thereby generated a favorable price unit which meets fully the operating conditions of a postage-meter machine.

If the date stamp should be pre-dated or post-dated for special reasons, then this is possible manually with a low effort by rotating with a stylus one or several of the counter wheels 16 through 18, as is usually performed in conventional postage-meter machines.

The two empty positions of the counter wheel 16 follow the counter numeral "9" according to FIG. 4. However, this is no absolute necessity. These empty positions can be neighboring at any desired position of the counter wheel 16 or they can be disposed individually and separately. Of course, the schematic of the empty step according to FIG. 5 has to be adapted in the coordination.

In expanding the initially recited object of the invention, the means of the stator part 12 of the postage-meter machine 11, as illustrated in FIG. 2, can also serve for lowering of or, respectively, for the bringing into print position the print block, which prints textual material and notices 5, as illustrated in FIG. 1. Furthermore, the means can also serve for actuating a so-called "kind-of-mailing" stamp. For this purpose, in each case, the print rotor 13 is to be brought into a corresponding angular position, where the two-sided bevelled shaft 34 of the coupler 32 is engaged with a respective slotted shaft 33'. In each case, a catch-stop actuator 24', a catch-stop row sequence 23' with one single catch stop 66', and a catch-stop wheel 16' are following to these respective slotted shafts 33'. In this case, the print block or, respectively, the "kind-of-mailing" stamp is actuable via the respective catch-stop wheel 16', for example, by four catch-stop steps in each case.

It will be understood that each of the elements described above, or two or more together, may also find a useful application in other types of setting devices for the application of stamps differing from the types described above.

While the invention has been illustrated and described as embodied in the context of a device for setting of a date stamp in a postage-meter machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A device for the setting of a date stamp of a postage meter machine, comprising at least a stator part;

a print rotor, pivotally disposed at the stator part;

counter wheels disposed coaxially and independently in the print rotor, wherein a first counter wheel represents single-digit positions of days of a month, a second counter wheel represents decimal positions of days of a month, a third counter wheel represents months, and a fourth counter wheel represents years of the date stamp;

at least one catch-stop drive comprising an electric drive motor disposed in the stator part, a catch-stop actuator disposed in the print rotor, and a catch-stop row sequence disposed in the print rotor, wherein the catch-stop row sequence is actuable by the catch-stop actuator and comprises at least two catch stops of differing lengths wherein the catch stops are rigidly connected to each other and are disposed parallel to each other;

control means, disposed in the stator part and coordinated to the catch-stop drive for stepwise rotating the counter wheels, and comprising a logic unit for controlling the electric drive motor and a clock module;

a coupler, coordinated to and forming a part of the catch-stop drive, for mechanically coupling the electric drive motor and the catch-stop actuator for a preset position of the print rotor;

catch-stop teeth disposed at the counter wheels, and tooth gaps of two different depths disposed at the counter wheels, wherein the tooth gaps are disposed between the catch-stop teeth, and the counter wheels are individually coordinated to and aligned with the catch stops, and wherein the catch stops springingly engage into the tooth gaps of the counter wheels.

2. The device according to claim 1, wherein the catch-stop row sequence comprises three catch stops having different lengths, wherein the longest catch stop is coordinated to and aligned with the first counter wheel representing the single-digit positions of the days of the month, and wherein the first counter wheel exhibits eleven tooth gaps of a smaller depth and one tooth gap of a larger depth;

wherein the medium-length catch stop is coordinated to and aligned with the second counter wheel representing the decimal positions of the days of the month, wherein the second counter wheel exhibits nine tooth gaps of a smaller depth and three tooth gaps of a larger depth, and wherein the shortest catch stop is coordinated to and aligned with the third counter wheel representing the month position and wherein this third counter wheel does not exhibit any tooth gaps of a larger depth.

3. The device according to claim 1, wherein the catch-stop actuator comprises a cam shaft and wherein the catch-stop row sequence is pivoted around a rigid axis and is deflected by the cam shaft against the force of a spring.

4. The device according to claim 1, further comprising position indicators for indicating and signalling the angular setting of the coupler and of the print rotor to the logic unit.

5. The device according to claim 1, wherein the logic unit is a microprocessor with a memory storage, and wherein a control program is store in the memory storage.

6. The device according to claim 1, further comprising a battery for energizing the electric drive motor.

7. The device according to claim 1, wherein the coupler is composed of a first half and of a second half, and wherein said first half and said second half are independent of each other and, upon a preset position of the print rotor, engage into each other coaxially and with low play.

8. The device according to claim 7, wherein the first half of the coupler is formed by a two-sided bevelled shaft and the second half of the coupler is formed by a slotted shaft, wherein the two-sided bevelled shaft is connected to the electric drive motor, and wherein the slotted shaft is connected to the catch-stop actuator.

9. A method for operating a device according to claim 1 for setting the date of the respective following day, comprising the steps initially bringing the print rotor into a position into which the electric drive motor and the catch-stop actuator are coupled by the coupler;

maintaining the print rotor in said position;

subsequently switching on the electric drive motor in each case for such a time until, starting from the days of the month 1 through 8, 10 through 18, 20 through 28, and 30, if the month in question comprises thirty-one days, in each case one single catch-stop step is performed, until, starting from the days of the month 9, 19, and 29, in each case three catch-stop steps are performed, until, starting from the days of the month 28, 29, 30 or 31, if the month in question comprises twenty-eight, twenty-nine, thirty, or thirty-one days, in each case and coordinated seventeen, sixteen, thirteen or, respectively, twelve catch-stop steps are performed.

10. The method according to claim 9, further comprising initiating the setting of the date in each case at midnight with a clock module.

11. A device for the setting of a date stamp (20) of a postage meter machine (11), which comprises at least a stator part (12) and a print rotor (13), pivotally disposed at the stator part (12), with counter wheels (16–19) disposed coaxially and independently in the print rotor (13), of which counter wheels (16–19) a first counter wheel (16) represents single-digit positions of days of a month, a second counter wheel (17) represents decimal positions of days of a month, a third counter wheel (18) represents months, and a fourth counter wheel (19) represents the years of the date stamp (20), and with at least one catch-stop drive as well as control means, by way of which the counter wheels (16–19) are rotatable stepwise, wherein the catch-stop drive comprises an electric drive motor (41), a coupler (32), a catch-stop actuator (24), and a catch-stop row sequence (23);

the control means comprise a logic unit (56) for controlling of the electric drive motor (41) and a clock module (58);

the electric drive motor (41) and the control means are disposed in the stator part (12) and the catch-stop actuator (24) and the catch-stop row sequence (23) are disposed in the print rotor (13);

the electric drive motor (41) and the catch-stop actuator (24) can be mechanically coupled by the coupler (32) in case of a preset position of the print rotor (13);

the catch-stop row sequence (23) is actuable by the catch-stop actuator (24) and comprises at least two rigidly connected and parallel to each other disposed catch stops (66–68) of differing lengths, and wherein the counter wheels (16–19) are furnished with catch-stop teeth (61) and tooth gaps (62, 62T) of two different depths, where the tooth gaps (62, 62T) are disposed between the catch-stop teeth (61), and wherein the counter wheels are individually coordinated to and aligned with the catch stops (66–68), and wherein the catch stops (66–68) springingly engage into the tooth gaps (62, 62T) of the counter wheels.

12. The device according to claim 11, wherein the catch-stop row sequence (23) comprises three catch stops (66–68);

the longest catch stop (66) is coordinated to and aligned with the first counter wheel (16) representing the single-digit positions of the days of the month, and wherein the first counter wheel (16) exhibits eleven tooth gaps (62) of smaller depth and one tooth gap (62T) of larger depth;

wherein the medium-length catch stop (67) is coordinated to and aligned with the second counter wheel (17) representing the decimal positions of the days of the month, and wherein the second counter wheel (17) exhibits nine tooth gaps (62) of smaller depth and three tooth gaps (62T) of larger depth, and wherein the shortest catch stop (68) is coordinated to and aligned with the third counter wheel (18) representing the month position, and wherein this third counter wheel (18) does not exhibit any tooth gaps (62T) of larger depth.

13. The device according to claim 11, wherein the catch-stop actuator (24) comprises a cam shaft (70) and wherein the catch-stop row sequence (23) can be pivoted around a rigid axis and can be deflected by the cam shaft (70) against the force of a spring.

14. The device according to claim 11, wherein position indicators (48, 54) are furnished which indicate the angular setting of the coupler (32) and of the print rotor (13) to the logic unit (56).

15. The device according to claim 11, wherein the logic unit (56) is a microprocessor with a memory storage, where a control program is stored in the memory storage.

16. The device according to claim 11, wherein the electric drive motor (41) can be fed by a battery (46).

17. A method for operating a device according to claim 11 for setting of the date of the respective following day, wherein the print rotor (13) is initially brought into a position and is maintained in said position in which the electric drive motor (41) and the catch-stop actuator (24) are coupled by the coupler (32), and wherein the electric drive motor (41) is subsequently switched on in each case for such a time until, starting from the days of the month 1 through 8, 10 through 18, 20 through 28, and 30, if the month in question comprises thirty-one days, in each case one single catch-stop step is performed, until, starting from the days of the month 9, 19, and 29, in each case three catch-stop steps are performed, until, starting from the days of the month 28, 29, 30 or 31, if the month in question comprises twenty-eight, twenty-nine, thirty, or thirty-one days, in each case and coordinated seventeen, sixteen, thirteen or, respectively, twelve catch-stop steps are performed.

18. The method according to claim 17, wherein the setting of the date in each case is initiated at midnight by a clock module (58).

19. The device according to claim 11, wherein the coupler (32) is composed of two independent halves, which engage into each other with low play and coaxially upon a preset position of the print rotor (13).

20. The device according to claim 19, wherein the one half of the coupler (32) is formed by a two-sided bevelled shaft (34), which two-sided bevelled shaft (34) is connected to the electric drive motor (41), and wherein the second half of the coupler (32) is formed by a slotted shaft (33), which slotted shaft (33) is connected to the catch-stop actuator (24).

* * * * *